US007510256B2

(12) United States Patent
Guarino et al.

(10) Patent No.: US 7,510,256 B2
(45) Date of Patent: Mar. 31, 2009

(54) REFLEX PRINTING WITH PROCESS DIRECTION STITCH ERROR CORRECTION

(75) Inventors: Gregg A. Guarino, Rochester, NY (US); Daniel W. Costanza, Webster, NY (US); Martin E. Hoover, Rochester, NY (US); James P. Calamita, Spencerport, NY (US); Abu S. Islam, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 372 days.

(21) Appl. No.: 11/092,677

(22) Filed: Mar. 30, 2005

(65) Prior Publication Data

US 2006/0221124 A1 Oct. 5, 2006

(51) Int. Cl.
*B41J 29/393* (2006.01)

(52) U.S. Cl. ..... 347/19

(58) Field of Classification Search ..... None
See application file for complete search history.

(56) References Cited

U.S. PATENT DOCUMENTS 4,575,739 A 3/1986 De Schamphelaere et al.
4,839,671 A 6/1989 Theodoulou et al.
4,878,063 A * 10/1989 Katerberg ..... 347/19
5,081,476 A 1/1992 Genovese
5,231,428 A 7/1993 Domoto et al.
5,444,525 A * 8/1995 Takahashi et al. ..... 399/76
5,889,534 A * 3/1999 Johnson et al. ..... 347/19
6,076,922 A 6/2000 Knierim
6,164,755 A * 12/2000 Yamamoto ..... 347/37
6,215,119 B1 4/2001 Markham et al.
6,300,968 B1 * 10/2001 Kerxhalli et al. ..... 347/116
6,663,206 B2 12/2003 Taylor
6,663,215 B2 * 12/2003 Klausbruckner et al. ..... 347/22
2004/0252149 A1 * 12/2004 Laaspere et al. ..... 347/16

* cited by examiner

*Primary Examiner*—Matthew Luu
*Assistant Examiner*—Justin Seo
(74) *Attorney, Agent, or Firm*—Oliff & Berridge, PLC

(57) ABSTRACT

A reflex printing device having multiple print heads mounted at different locations around the circumference of the drum at different "angles" and an encoder disk mounted on the drum to allow for detection of the drum position as a function of time. An image defect due to a misalignment in the print process direction of the output from the multiple print heads is corrected by detection of an encoder position error function subtracted from itself shifted by the angle between the print heads.

12 Claims, 6 Drawing Sheets

FIG. 1
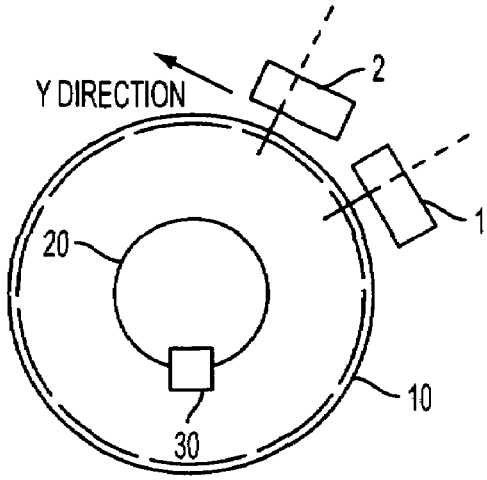
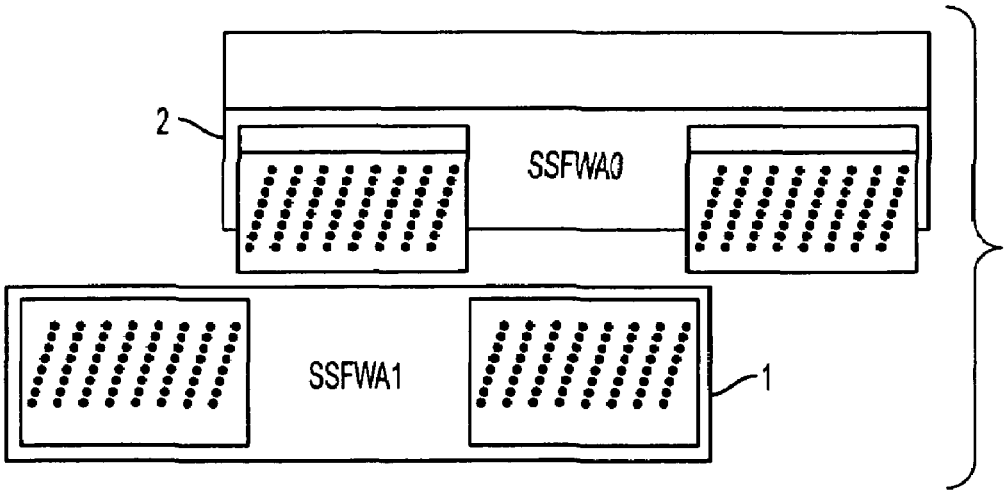
FIG. 2

REFLEX PRINTING WITH PROCESS DIRECTION STITCH ERROR CORRECTION

BACKGROUND

The subject matter of this application relates to reflex printing, and more specifically provides a device and method for reducing printing defects resulting from a phase difference in an encoder error function, such as stitch error correction.

In reflex printing, a cylindrical drum rotates past a print head which ejects ink onto the surface of the drum. In traditional reflex printing devices, there is only one print head. Therefore, the entire image is ejected by one full-width print head. The print head is made-up of an array of very small orifices through which liquid ink is ejected. The print head is fired according to a drum position signal, rather than a time-based synchronization signal.

The ink is ejected from the print head onto the drum and is built-up over a series of passes to form a complete image. Because a sufficient amount of ink cannot be deposited in one revolution of the drum to create the entire image, a portion of the image is ejected per revolution of the drum. For example, a first portion of the image is ejected onto the drum in the first revolution. The print head is then shifted, or indexed left to right, i.e., along the axis of the drum and another portion of the image is ejected onto the drum. The process is repeated by indexing the print head along the axis of the drum until the complete image is built-up.

It is known to monitor the position of the imaging surface of the drum by a rotary motion encoder and to control the output of data by a print head or an image bar which forms a latent image on the imaging surface so that an image, such as characters, are formed at the proper locations on the imaging surface. In practice, the encoder may be mounted slightly off of the axis of drum rotation leading to a "runout"-type error in the encoder reading. Such "runout" results in stitching errors in the process direction. That is, the output in the process direction from one print head is not aligned relative to the output in the process direction of a second print head.

SUMMARY

The subject matter of this application pertains to devices and methods of reflex printing that include correction of print defects caused by encoder "runout" in print devices having multiple print heads. In such devices and methods, "runout"-type errors in the encoder reading resulting in stitching errors in the process direction are exacerbated due to the output of a first print head relative to a second printhead.

According to an exemplary embodiment of the subject matter of this application, a reflex printing device has multiple print heads mounted at different locations around the circumference of the drum at different "angles". The drum position is determined from an encoder mounted on the drum. In traditional xerographic systems, an image is laid down as a function of time while trying to keep the velocity of the item receiving the image constant. In reflex printing, the actual position of the drum is measured as a function of time and ink ejected from the print heads to form the image based on that position. Because the drum could have small variations in velocity, print defects are difficult to detect because the defect is compensated for by only ejecting the image onto the drum when the drum is at the proper position.

The subject matter of the application includes devices and methods to achieve a desired dpi resolution, while also correcting an image defect commonly referred to as "y stitch error". In devices having multiple print heads, stitch error caused by encoder runout is the encoder position error function subtracted from itself shifted by the angle between the heads. The image defect referred to as "y stitch error" is a misalignment in the y, or print process, direction of the output from the heads at different angles. In an embodiment, the device uses an encoder disk mounted to a rotating drum that, in conjunction with an encoder sensor, forms a position sensor. In an embodiment, the subject matter of this application includes, for example, electronics and algorithms by which the sensor output is processed to derive a signal that controls firing of the heads to meet the requirements of dpi resolution and acceptable y stitch error.

One aspect of this invention provides computer readable instructions that are installable in a reflex printing-type image formation device that include an algorithm that corrects for a misalignment of print heads that cause sinusoidal-type stitch error output from the image formation device. The computer readable instructions contain, among other things, the look-up table, or map, of known ink placement over the circumferential surface of a print drum. The computer readable instructions correct for the stitch error by processing signals received from a sensor to adjust for the error by outputting instructions controlling ejection of ink from print heads. As used herein, computer readable instructions include, for example, software, firmware, hardware, and the like.

BRIEF DESCRIPTION OF THE DRAWINGS

FIG. 1 shows a schematic representation of a drum of a reflex printing device having multiple print heads mounted at different angles;

FIG. 2 shows a view of the ejecting surfaces of exemplary print heads;

DETAILED DESCRIPTION OF EMBODIMENTS

Figure 3:
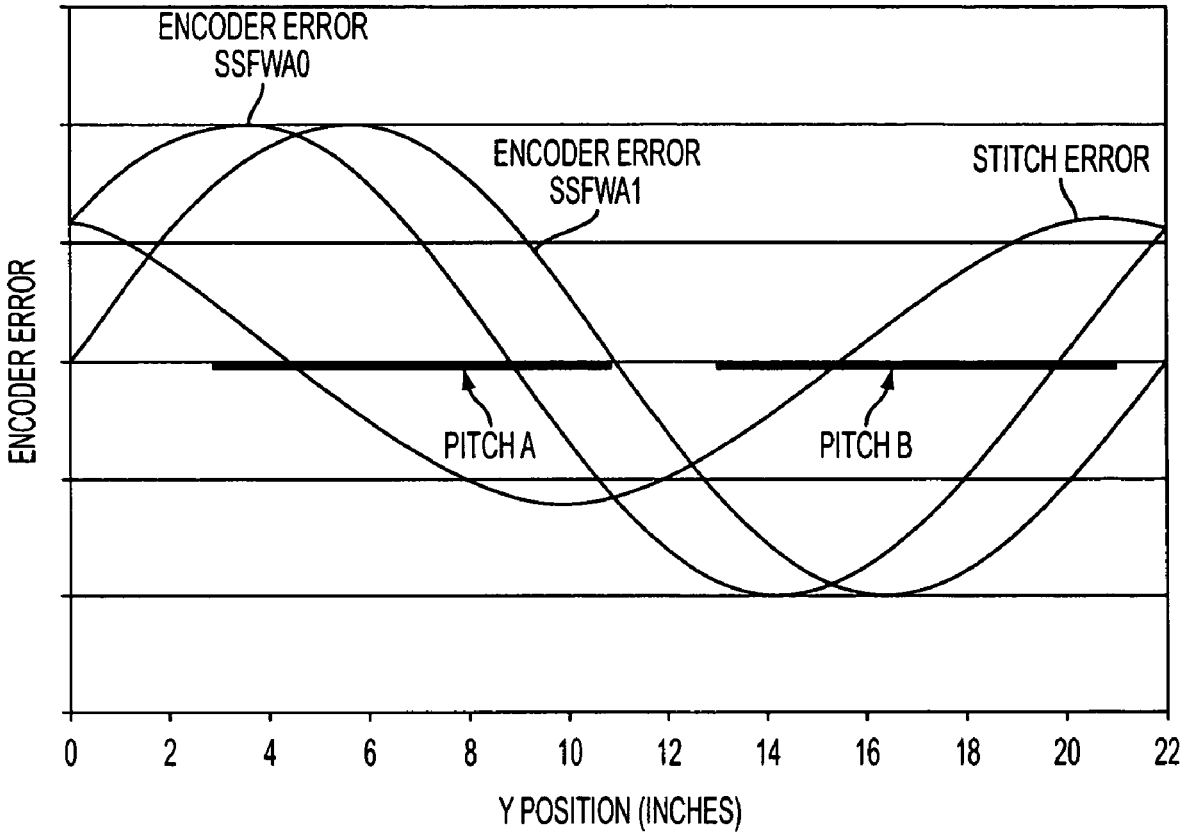
FIG. 3 is a graph showing the occurrence of stitch error in a reflex printing device having multiple print heads mounted at different angles.

The subject matter of this application relates to stitch error correction in a reflex printing device having multiple print heads mounted about a circumference of a drum that are offset from one another by an angular distance.

FIG. 1 shows a schematic representation of a drum of a reflex printing device having multiple print heads mounted at different angles. As shown in FIG. 1, a reflex print device includes a hollow shaft drum 10 and print heads 1 and 2. During printing, the hollow shaft drum 10 rotates on bearings attached to a fixed I-beam (not shown). An image is formed on the drum 10 by the ejection of liquid ink from the print head 1 and the print head 2, which are mounted at different angles from one another. An encoder disk 20 is mounted to an end side of the drum 10. The encoder disk 20 and an encoder sensor 30 track the motion of the drum 10 as the drum 10 revolves. A timing signal that controls the firing of the print heads 1 and 2 is derived from an output of the encoder sensor 30, as will be explained in greater detail below. Each of the print heads 1 and 2 receive the same timing signal that determines when the print heads 1 and 2 fire. There is a fixed delay between the firing of the print head 1 and the firing of print head 2. The delay can be used to align the output of print heads 1 and 2 at a point in the "y" direction (i.e., the print process direction).

However, off center mounting of the encoder disk 20, referred to as "runout", will cause the y-direction alignment between the output of the print heads 1 and 2 to vary cyclically over the drum revolution creating measurement error in terms of when the print heads 1 and 2 are fired.

FIG. 2 shows a view of the ejecting surfaces of exemplary print heads. As shown in FIG. 2, four print heads are located on assemblies called Semi-Staggered Full Width Arrays (SSFWA's). In the example, there are two SSFWA's, here referred to as Print Head 1 and Print Head 2. It is the separation between the print heads that contributes to the error. For example, for any given y-position on the drum 10 the encoder error for the print head 1 is different from the encoder error for the print head 2 because the print heads are fired at different times resulting in "stitch error". As discussed above, "stitch error" is a print defect resulting from the y-direction phase difference in the encoder error function from print head 1 to print head 2.

Because of the limitations in a density of print heads 1 and 2 openings or orifices that may be disposed on a print head, the desired print density or dpi requirements cannot be achieved and a sufficient amount of ink cannot be deposited in one revolution of the drum 10 to create an entire image. Therefore, a portion of the image is ejected per revolution of the drum 10. In practice, a first portion of the image is ejected onto the drum 10 in the first revolution. The print heads 1 and 2 are then shifted, or indexed left to right, i.e., along the axis of the drum 10 and another portion of the image is ejected onto the drum 10. The process is repeated by indexing the print heads 1 and 2 along the axis of the drum 10 until the complete image is built-up. By index shifting the print heads 1 and 2, the desired print density or dpi requirements can be achieved by "filling-in" during each successive revolution of the drum 10. However, if there is "runout" as the drum 10 is rotating, e.g., the encoder 20 is not concentric with the drum 10, there will be measurement error in terms of when the print heads 1 and 2 are fired.

If a reflex printing device has only one print head, the error is less pronounced than in a device having multiple print heads because a difference between two or more objects is not being measured. However, in a device having two or more print heads that are putting down an image, the print heads are trying to register images right next to each other and a more pronounced error is produced.

FIG. 3 is a graph showing the occurrence of stitch error in a reflex printing device having multiple print heads mounted at different angles. As shown in FIG. 3, the y-axis represents encoder error and the x-axis represents the y-position (print process direction) measured in inches. The error is a sinusoidal error that varies over the circumference of the drum.

Figure 4:
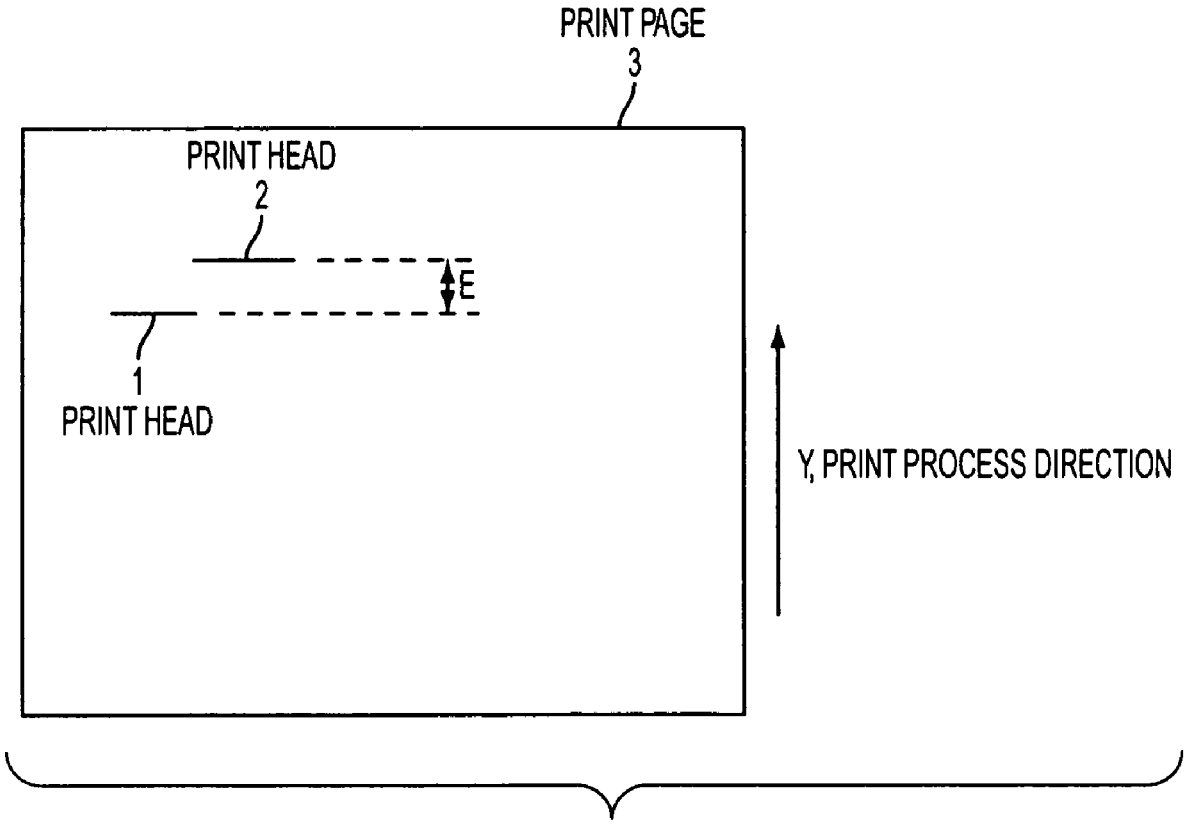
FIG. 4 shows an occurrence of stitch error on a printed page.

FIG. 4 shows an occurrence of stitch error on a printed page. In FIG. 4, a print page 3, such as a sheet of paper printed on a reflex printing device having two print heads, has two horizontal lines. A first line is put down by print head 1 and a second line is put down by print head 2. Ideally, the line put down by print head 1 would line up exactly with the line put down by print head 2. However, there is some built in error that's a function of geometric or mechanical error based on how the encoder disk 20 that is measuring the position of the drum 10 is offset from center. The error in measuring the position of the drum 10 is translated to the print heads 1 and 2 during printing and a spacing error ("E") between the respective lines put down by print head 1 and print head 2 will result. The subject matter of this application reduces and/or eliminates the error "E" by measuring and correcting for the error "E" so that such print lines will line-up.

Figure 5:
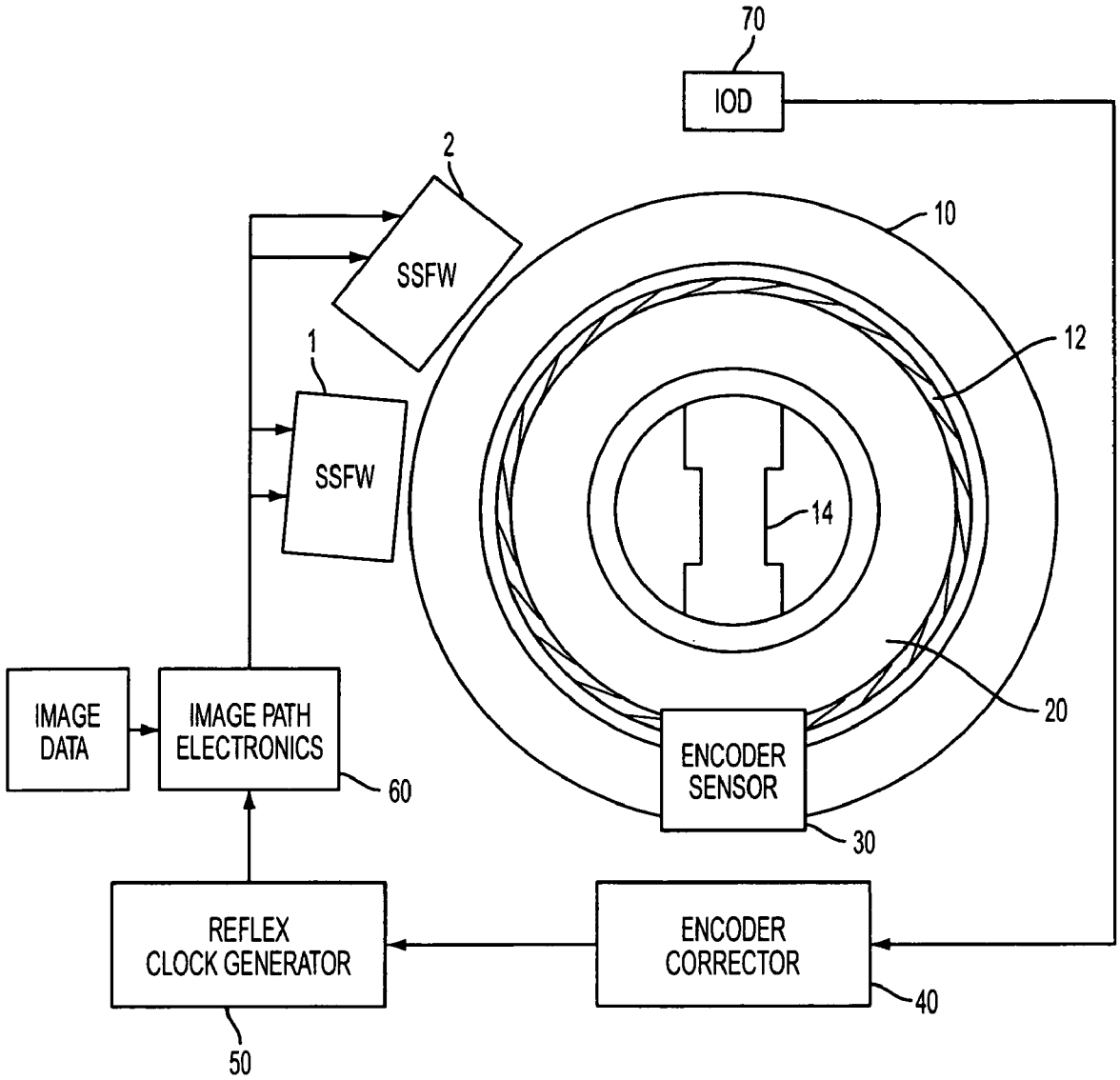
FIG. 5 shows an exemplary embodiment of a reflex printing device and stitch error correction system having an Image on Drum sensor.

FIG. 5 shows an exemplary embodiment of a reflex printing device and stitch error correction system according to the subject matter of this application. As shown in FIG. 5, a hollow shaft drum 10 rotates on bearings 12 attached to a fixed or non-rotating I-beam 14. In an exemplary embodiment, a heater (not shown) is disposed inside the drum 10. The print heads 1 and 2 are located on SSFWA's and are mounted at different angles from one another. An encoder disk 20 is mounted to an end side of the drum 10 and an encoder sensor is positioned to detect the position of the disk as it rotates with the drum. The encoder corrector 40 outputs a corrected encoder signal based on the output of the sensor 30 and a pre-learned table of error versus position. This is then multiplied up by the PLL 50 to achieve a resolution of 1/20 pixel. The image path electronics 60 then sends image data to the print heads 1 and 2, and controls the timing of when the print heads 1 and 2 fire, based on the output of the PLL 50.

In operation, an image is formed on the drum 10 by print heads 1 and 2. An encoder disk 20, made-up of a disk with a series of lines, is mounted on a side of the drum 10 and operates to output a square wave signal at the native resolution of the encoder disk 20. For example, a printer may have a 5000 line disk that produces 5000 pulses per revolution with the angle of rotation between pulses being 0.072 degrees.

The encoder disk 20 and an encoder sensor 30 track the motion of the drum 10 as the drum 10 revolves. A timing signal that controls the firing of the print heads 1 and 2 is derived from an output of a signal from the encoder sensor 30. The encoder sensor 30 and encoder disk 20 used in the exemplary embodiment were supplied by Encoder Technology, and were model numbers M2.26-5000-35 and 100040-53, respectively. The disk 20 has evenly spaced radial lines around its edge, and the encoder sensor 30 optically senses the lines. The encoder sensor 30 then outputs one pulse for each line as it crosses through the sensor 30. Each of the print heads 1 and 2 receive the same timing signal that determines when the print heads 1 and 2 fire. There is a fixed delay between the firing of the print head 1 and the firing of print head 2. The delay can be used to align the output of print heads 1 and 2 at a point in the "y" direction (i.e., the print process direction).

An encoder corrector circuit 40 operates by tracking the period of the output of the encoder sensor 30 and synthesizing a corrected signal with a period that is proportional to that of the input signal. The ratio of input period to output period is selected such that an integer multiplier PLL reflex clock generator 50 produces the desired dpi. In addition, the ratio of input is changed as a function of the position of the drum 10 in order to correct the stitch error "E".

The encoder corrector circuit 40 includes a memory that stores signals received from sensors. The memory can be implemented using any appropriate combination of alterable, volatile or non-volatile memory or non-alterable, or fixed, memory. The alterable memory, whether volatile or non-volatile, can be implemented using any one or more of static or dynamic RAM, a floppy disk and disk drive, a writable or re-writable optical disk and disk drive, a hard drive, flash memory or the like. Similarly, the non-alterable or fixed memory can be implemented using any one or more or ROM, PROM, EPROM, EEPROM, an optical ROM disk, such as a CD-ROM or DVD-ROM disk and disk drive or the like.

Although the encoder corrector is described as a "circuit", the encoder corrector may be implemented in preferred embodiments using "firmware", software, hardware, and the like. Additionally, although the invention will be described with reference to a reflex-type printer, other image formation devices having a material ejected on to a drum surface are also contemplated for use with the systems and methods of the subject matter described in this application.

In various exemplary embodiments, the encoder corrector circuit 40 may be implemented or embodied in using."firmware", software, hardware, and the like. Additionally, although the invention will be described with reference to a reflex printer, other image formation devices which incorporate reflex-type devices, such as photocopiers, multifunction devices, and the like, are also contemplated for use with the systems and methods of this invention.

The encoder corrector circuit 40 produces a synthesized encoder signal that is modulated to correct stitch error. The synthesized encoder signal is then multiplied by the PLL 50, to produce a digital square wave signal. In an exemplary embodiment, the digital square wave signal may be about 20 pulses per pixel. This signal is divided by 20 to form a "pixel clock" that controls firing of the print heads 1 and 2. A sub-pixel resolution of 1/20 of pixel can therefore be used to adjust the timing of the pixel clock.

In an embodiment, the process for determining the correction factor by which the line spacing, such as shown in FIG. 4, is to be altered includes measuring the stitch error "E" at several points during a revolution of the drum 10. In an embodiment, this is a pre-learned error that is measured by an electronic image sensor 70 that is positioned over the drum 10 and measures the error "E" between the lines out put by print head 1 and the lines out put by print head 2. The pre-learned error may be measured once and stored in a memory of the corrector circuit 40, or the error may be periodically measured throughout the life of the machine. Once the error is measured as a function of the circumference of the drum 10 by reading the encoder signal, correction of the image path can be achieved, as described below.

Although pre-learning the error has been described using a sensor 70 to measure the error, the error may also be determined by running a series of print outs and then scanning the print outs to measure the error.

In an exemplary embodiment, the Image on Drum sensor 70 is a full width image sensor that measures the image placement on the surface of the drum 10. Because the sensor 70 is synchronized with the encoder 20, the sensor 70 measures images with respect to a certain location on the circumference of the drum 10. The sensor 70 can therefore detect and obtain the actual error "E" of the ink as it lands on the drum during a complete revolution of the drum 10. Data, in the form a signal from the sensor 70, is sent to the encoder corrector circuit 40 where the data is stored as a look-up table, or map representing the sinusoidal error per revolution of the drum 10. The encoder sensor 30 and encoder disk 20 used in the exemplary embodiment were supplied by Encoder Technology, and were model numbers M2.26-5000-35 and 100040-53, respectively. The disk 20 has evenly spaced radial lines around its edge, and the encoder sensor 30 optically senses the lines. The encoder sensor 30 then outputs one pulse for each line as it crosses through the sensor 30.

Figure 6:
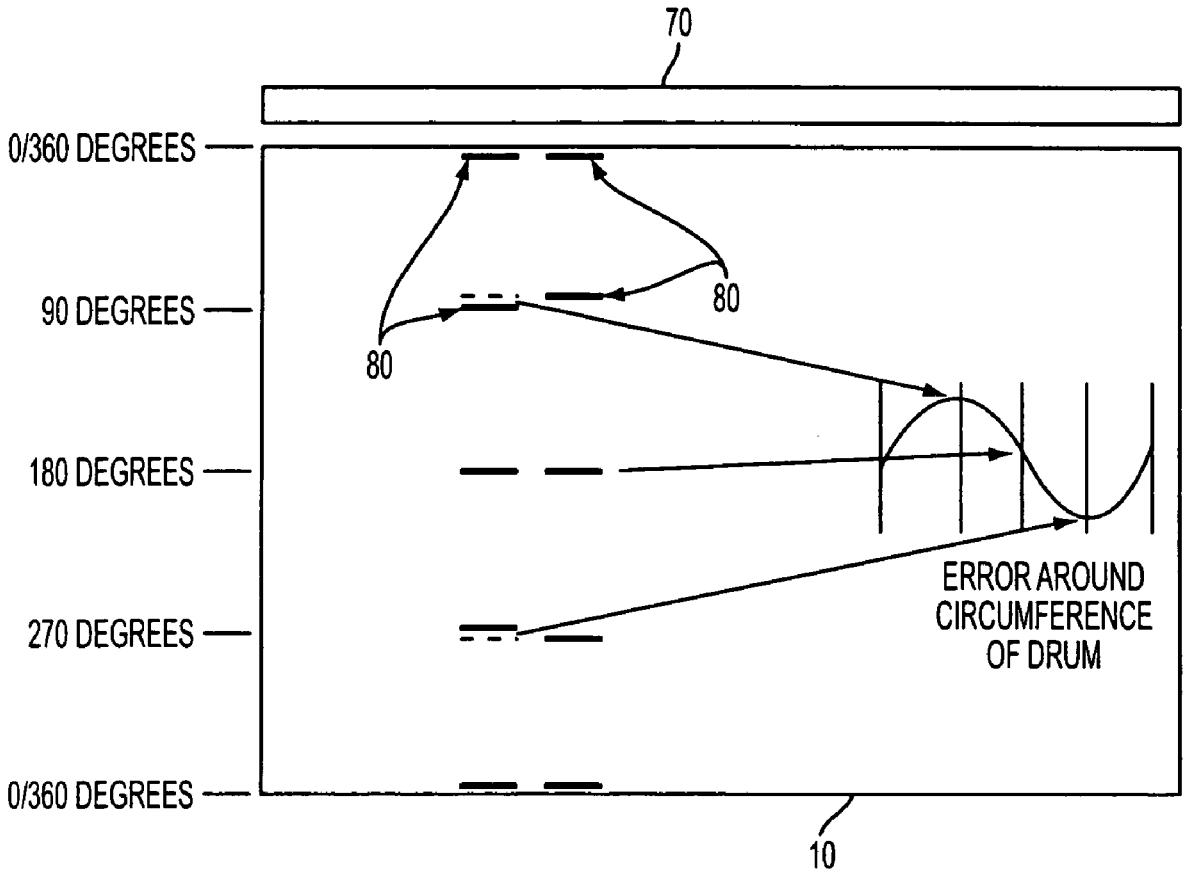
FIG. 6 shows an exploded view of the surface of the drum of FIG. 5.

FIG. 6 shows an exploded view of the surface of the drum of FIG. 5. As shown in FIG. 6, the sensor 70 measures marks 80 ejected onto the drum 10 from each of the print heads 1 and 2. The sensor 70 detects the stitch error that occurs as a result of offset between print head 1 and print head 2 around the circumference the drum 10. A signal from the sensor 70 indicating the placement of the marks 80 on the circumference of the drum 10 is sent to the encoder corrector 40 where signal data is processed to fit a sine wave to the detected error "E" (see FIG. 4).

The device and method according to the subject matter of this application, reduces and/or eliminates such error by measuring the stitch error "E" at several points around the drum 10 per revolution using the sensor 70. For example, the sensor 70 may measure points at 0°, 90°, 180°, 270° and 360/0°, as shown in FIG. 6. At each point, a correction factor is computed, using the mathematical formula:

$$C = 1 + \frac{E}{N \cdot LineSpacing}$$

wherein:

N=the number of pixels delayed between print head 1 and print head 2 firing.

$D_a$=the actual distance traveled in y between print head 1 and print head 2.

$D_d$=the distance that would have resulted in zero stitch.

$D_c$=the distance that will be traveled in N lines after correction is applied.

The correction factor C, can be derived as follows:

$D_a$=N·Line Spacing.

$D_d$=N·Line Spacing+E $D_c$=N·C·Line Spacing

The drum revolution is divided into segments corresponding to a predetermined number of lines on the encoder disk 20, each of which has its line spacing altered by the factor C that most closely corresponding to its physical location. In this case, making line-to-line spacing larger by an appropriate amount can cause the page to advance farther before print head 2 fires, thereby causing the segments to line up.

Therefore, C is determined by setting the desired distance equal to the distance after correction is applied:

$$D_c = D_d$$

$$N \cdot C \cdot \text{Line Spacing} = N \cdot \text{Line Spacing} + E$$

$$C = \frac{N \cdot LineSpacing + E}{N \cdot LineSpacing}$$

$$C = 1 + \frac{E}{N \cdot LineSpacing}$$

The encoder signal from sensor 30 is outputted to the encoder corrector 40 that incorporates the measured error stored in the corrector circuit 40 as a look-up table or map. The encoder corrector 40 runs an algorithm that fits, e.g., adds or subtracts the known sinusoidal error (FIG. 2) from the real encoder signal that is received from the encoder sensor 30. In other words the encoder corrector 40 is modifying the real encoder signal by a sine wave that represents the error signal. The encoder corrector 40 outputs the corrected encoder signal to the PLL reflex clock generator 50 that controls the firing of the print heads 1 and 2.

By modifying the signal between where it is sensed at the encoder sensor 30 and where it is read by the reflex clock generator 50 the "stitch error", "E" due to the positioning of the print heads 1 and 2 and the rotation of the drum 10, is reduced and/or removed and the image path is corrected. By manipulating the raw data received from the encoder sensor 30 the difference in the image path due to the positional error "E" caused by the rotation of the drum 10 is corrected.

In an embodiment, the encoder corrector 40 includes a memory for storing a look-up table or map of the error for one complete cycle of the sinusoid in one revolution of the drum 10. In an embodiment, one or more of the encoder sensor 30, encoder corrector 40, PLL Reflex Clock Generator 50 may be embodied in a single microprocessor. Alternatively, at least the encoder corrector 40 and the reflex clock generator 50 would can be combined in a single microprocessor or on a portion of another microprocessor in a reflex printer.

Figure 7:
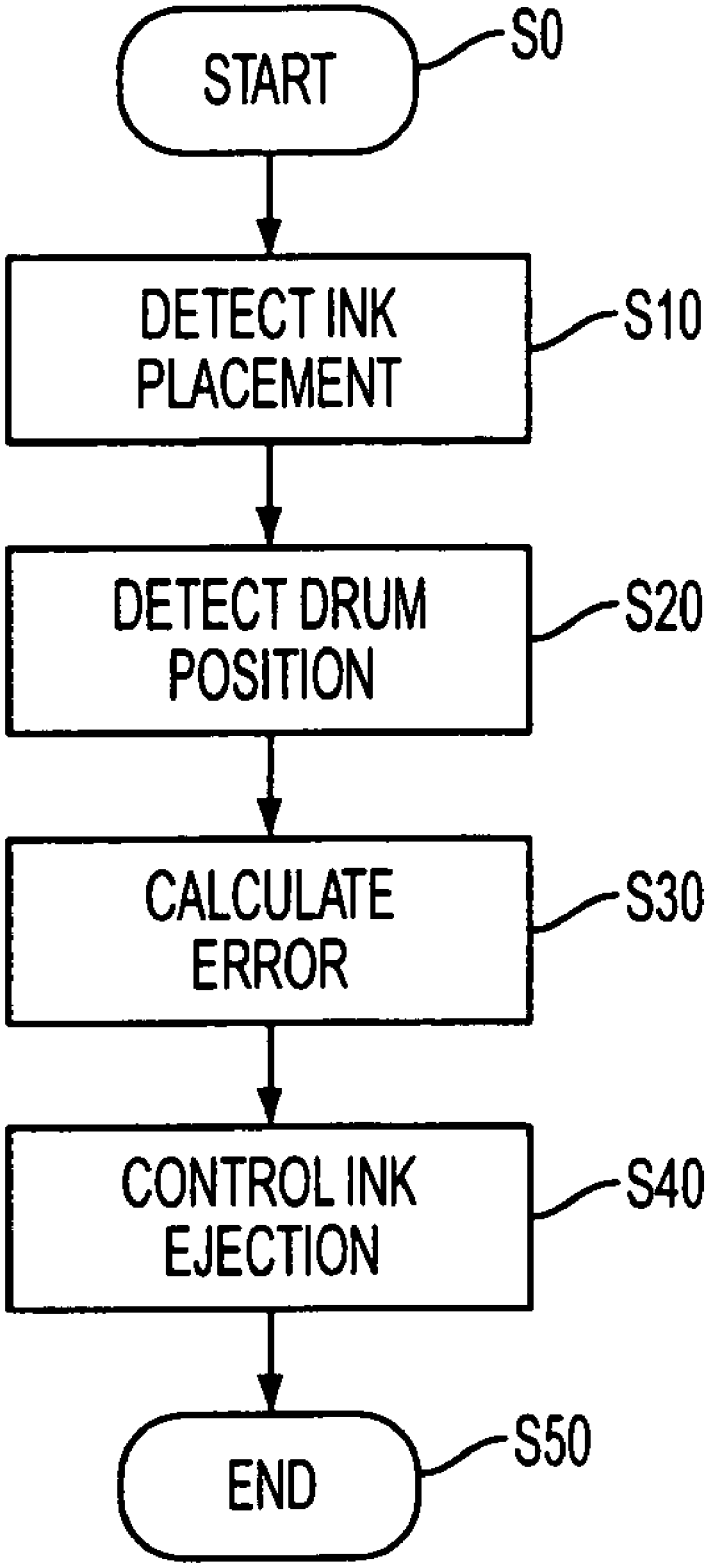
FIG. 7 is a flowchart of an exemplary process of stitch error correction.

An exemplary embodiment of the stitch error correction process occurs as shown on FIG. 7. As shown on FIG. 7, the process begins at step SO and proceeds to Step S10 where the process of "pre-learning" the error begins. At step S10, marks, or ink placement, on the surface of a rotating drum 10 are sensed by an ink sensor 70. A signal is sent from the ink sensor 70 to the encoder corrector circuit 40 where the signal is stored in a memory. Placement of the marks on the drum surface is accurately recorded by comparing relative placement of the marks on the surface of the drum 10 to the position of the encoder disk 20 as the encoder disk 20 rotates with the drum 10. Because the encoder disk 20 is known to have a predetermined number of lines, the encoder sensor 30 can accurately determined the position of the drum as it rotates.

At step S20 the position of the encoder disk 20, and therefore the position of the drum 10 is detected by the encoder sensor 30. A signal representing the position of the drum 10 is stored in a memory of the encoder corrector circuit 40. The process proceeds to step S30 where the stitch error is calculated. As discussed above, the stitch error results from runout error in the encoder signal. The runout error becomes pronounced over a revolution of the drum 10 and results in an offset of ink ejected onto the surface of the drum 10. Because the error has been "pre-learned" the amount of y stitch error is known. In this case the error is sinusoidal due to the rotation of the drum 10. At step S30, signals from the encoder sensor 30 are processed by the encoder corrector circuit 40 to calculate the error and correct for the stored sinusoidal error. The corrected signals are then used to control ink ejection at step S40.

At step S40, a corrected control signal is output from the encoder corrector 40 to delay firing of at least one of the print heads to compensate for the misalignment as the drum 10 rotates. By so delaying the firing based on the corrected output control signal, the stitch error is reduced and\or eliminated. The process ends at step S50.

It will be appreciated that various of the above-disclosed and other features and functions, or alternatives thereof, may be desirably combined into many other different systems or applications. Also that various presently unforeseen or unacticipated alternatives, modifications, variations or improvements therein may be subsequently made by those skilled in the art which are also intended to be encompassed by the following claims.

What is claimed is:

1. An image formation apparatus, comprising:

a rotatable drum;

at least a first print head and a second print head, each disposed over a surface of the drum at different angular positions, so as to eject ink onto the surface of the drum from different angles;

an encoder disk connected to an axial end of the drum that rotates with the drum;

an encoder sensor positioned to detect a position of the encoder disk as the encoder disk rotates with the drum;

a ink sensor positioned over the surface of the drum that detects a relative position of ink ejected on to the surface of the drum, as a function of a circumference of the drum, during a complete revolution of the drum; and an encoder corrector operably connected to the first print head, the second print head, the encoder disk, the encoder sensor and the ink sensor, wherein the encoder corrector receives signals from the ink sensor and the encoder sensor, respectively, and reduces stitch error by controlling a timing of ink ejection from the first and second print heads based on the received signals, and the stitch error is a sinusoidal error that varies over the circumference of the drum.

2. The image formation apparatus of claim 1, wherein the encoder corrector controls the timing of ink ejection by delaying or advancing ink ejection from at least the first print head or the second print head to reduce the stitch error.

3. The image formation apparatus of claim 1, wherein the encoder corrector tracks a period of the signal from the encoder sensor and synthesizes a corrected signal with a period proportional to the signal from the encoder sensor to reduce the stitch error.

4. The image formation apparatus of claim 1, wherein the signal received from the ink sensor is stored in a memory of the encoder corrector as a look-up table or map representing the stitch error as a sinusoidal error.

5. The image formation apparatus of claim 4, wherein the encoder corrector processes the signal from the encoder sensor to fit the sinusoidal error stored in the memory of the encoder corrector and controls firing of the at least the first and second print heads to reduce the stitch error based on the processed signal.

6. An image formation apparatus, comprising:

a rotatable drum;

at least a first print head and second print head;

an encoder disk;

an encoder sensor;

a memory;

an ink placement sensor; and a controller operably connected to the first and second print heads, the encoder disk, the encoder sensor and the ink placement sensor, the controller configured to:

detect placement of marks on a surface of the rotatable drum;

detect a relative position of the drum when the marks are placed on the surface of the drum, as a function of a circumference of the drum, during a complete revolution of the drum;

store data representing the detected placement of the marks and the detected relative position of the drum in the memory;

calculate an error of ink placement on the surface of the drum based on the stored data; and reduce error of ink placement by controlling ejection of ink from at least the first and second print heads onto the surface of the drum based on the calculated error, wherein the calculated error is a sinusoidal error that varies over the circumference of the drum.

7. The image formation apparatus of claim 6, wherein the controller is further configured to reduce the error of ink placement on the surface of the drum by determining a correction factor by which the ejection of ink from at least the first and second print heads is altered based on the stored data.

8. The image formation apparatus of claim 6, wherein the controller is further configured to reduce the error of ink placement on the surface of the drum by correcting the ink placement on the surface of the drum by modifying a signal representing the relative position of the drum by a sine wave corresponding to the calculated error of detected marks on the surface of the drum.

9. The image formation apparatus of claim 6, wherein the controller is further configured to store the data representing the detected placement of the marks and the detected relative position of the drum in the memory as a look-up table or map.

10. The image formation apparatus of claim 6, wherein the controller is further configured to reduce the error of ink placement on the surface of the drum by delaying or advancing ink ejection from at least the first or second print heads.

11. The image formation apparatus of claim 1, wherein the controlling the timing of ink ejection is based on correction values, the correction values based on the stitch error, and the encoder corrector is configured to apply different correction values to at least one of the at least two print heads at different rotational positions of the drum during a single revolution of the drum.

12. The image formation apparatus of claim 6, wherein the controlling ejection of ink is based on correction values, the correction values based on the calculated error, and the controller is configured to apply different correction values to at least one of the at least two print heads at different rotational positions of the drum during a single revolution of the drum.

* * * * *